US010660167B2

(12) United States Patent
Han

(10) Patent No.: US 10,660,167 B2
(45) Date of Patent: May 19, 2020

(54) LIGHT EMITTING DIODE MODULE, LIGHT EMITTING DIODE DRIVER, AND LIGHT EMITTING DIODE LIGHTING APPARATUS

(71) Applicant: SAMSUNG ELECTRONICS CO., LTD., Suwon-si, Gyeonggi-do (KR)

(72) Inventor: Deok Hee Han, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 16/393,091

(22) Filed: Apr. 24, 2019

(65) Prior Publication Data

US 2020/0100334 A1 Mar. 26, 2020

(30) Foreign Application Priority Data

Sep. 21, 2018 (KR) ..... 10-2018-0113438

(51) Int. Cl.
*H05B 33/08* (2020.01)
*G09G 3/34* (2006.01)

(52) U.S. Cl.
CPC ..... *H05B 33/0809* (2013.01); *H05B 33/086* (2013.01); *H05B 33/0827* (2013.01)

(58) Field of Classification Search
CPC ..... H05B 33/08; H05B 33/0803; H05B 33/0809; H05B 33/0815; H05B 33/0827; H05B 33/0842; H05B 33/086; H05B 33/0857; G09G 3/32; G09G 3/34; G09G 3/3406; G09G 3/342
See application file for complete search history.

(56) References Cited

U.S. PATENT DOCUMENTS

| | | | | |
|---|---|---|---|---|
| 8,339,070 | B2 | 12/2012 | Lai | |
| 9,347,660 | B1 | 5/2016 | Zadro | |
| 9,892,693 | B1 | 2/2018 | Kumar et al. | |
| 2004/0036418 | A1* | 2/2004 | Rooke | H05B 33/0815 315/77 |
| 2006/0109219 | A1* | 5/2006 | Robinson | G09G 3/14 345/83 |

(Continued)

FOREIGN PATENT DOCUMENTS

| | | | |
|---|---|---|---|
| JP | 2013-254568 | A | 12/2013 |
| KR | 10-2011-0102062 | A | 9/2011 |

(Continued)

*Primary Examiner* — Thai Pham
(74) *Attorney, Agent, or Firm* — Lee IP Law, PC

(57) ABSTRACT

A light emitting diode (LED) lighting apparatus includes an LED driver that outputs a driving current, a switch circuit that selects at least one division terminal among a first division terminal to a fourth division terminal and electrically connects the selected at least one division terminal with a driving current terminal receiving the driving current, a first resistor circuit that is connected with the first and second division terminals, a second resistor circuit that is connected with the third and fourth division terminals, a first LED light source that is electrically connected with the first resistor circuit and emits a first light having a first color temperature, and a second LED light source that is electrically connected with the second resistor circuit and emits a second light having a second color temperature higher than the first color temperature.

18 Claims, 11 Drawing Sheets

(56) References Cited

U.S. PATENT DOCUMENTS

| | | | | |
|---|---|---|---|---|
| 2009/0026913 | A1* | 1/2009 | Mrakovich | H05B 33/0803 313/498 |
| 2012/0087130 | A1* | 4/2012 | Kung | H05B 33/0809 362/249.02 |
| 2012/0098460 | A1* | 4/2012 | Miyasaka | H05B 33/0812 315/294 |
| 2014/0168965 | A1 | 6/2014 | Moon et al. | |
| 2015/0008848 | A1 | 1/2015 | Chen et al. | |
| 2016/0249431 | A1 | 8/2016 | Yan et al. | |
| 2019/0159311 | A1* | 5/2019 | Zhang | H05B 33/0827 |

FOREIGN PATENT DOCUMENTS

| | | | |
|---|---|---|---|
| KR | 10-1139429 | B1 | 4/2012 |
| KR | 10-2013-0034873 | A | 4/2013 |
| KR | 10-1664767 | B1 | 10/2016 |

* cited by examiner

LIGHT EMITTING DIODE MODULE, LIGHT EMITTING DIODE DRIVER, AND LIGHT EMITTING DIODE LIGHTING APPARATUS

CROSS-REFERENCE TO RELATED APPLICATIONS

Korean Patent Application No. 10-2018-0113438 filed on Sep. 21, 2018, in the Korean Intellectual Property Office, and entitled: "Light Emitting Diode Module, Light Emitting Diode Driver, and Light Emitting Diode Lighting Apparatus," is incorporated by reference herein in its entirety.

BACKGROUND

1. Field

Embodiments relate to a lighting apparatus and, more particularly, relate to a light emitting diode (LED) module, an LED driver, and an LED lighting apparatus.

2. Description of the Related Art

A light emitting diode (LED) has various advantages such as low power consumption, long lifetime, etc. For this reason, nowadays, an LED device is being widely used as a lighting apparatus, a head lamp for vehicle, a light source for backlight of a display device, and so forth.

The LED device emits a light having a correlated color temperature (CCT). In various application environments, changing the color temperature of the light emitted from the LED device depending on an ambient environment or the requirements of a user is desired. To change the color temperature of the light emitted from the LED device, a color temperature-variable lighting apparatus may use a plurality of LED devices having different color temperatures and a plurality of LED drivers controlling the plurality of LED devices respectively.

However, when the plurality of LED drivers are used, or a separate component which adjusts a channel of a current to be provided to each LED device is required, complexity and cost increases.

SUMMARY

According to an example embodiment, a light emitting diode (LED) lighting apparatus includes an LED driver that outputs a driving current, a switch circuit that selects at least one division terminal among a first division terminal to a fourth division terminal and electrically connects the selected at least one division terminal with a driving current terminal receiving the driving current, a first resistor circuit that is connected with the first and second division terminals, a second resistor circuit that is connected with the third and fourth division terminals, a first LED light source that is electrically connected with the first resistor circuit and emits a first light having a first color temperature, and a second LED light source that is electrically connected with the second resistor circuit and emits a second light having a second color temperature higher than the first color temperature.

According to an example embodiment, an LED module includes a first LED light source that receives a first division current through a first division current terminal and emits a first light having a first color temperature based on the first division current, a second LED light source that receives a second division current through a second division current terminal and emits a second light having a second color temperature based on the second division current, and a division circuit that is connected with a driving current terminal receiving a driving current from an external device, the first division current terminal, and the second division current terminal, and divides the driving current into a first division current and a second division current in response to a color temperature control signal from the external device, the division circuit outputting the first division current to the first division current terminal and outputting the second division current to the second division current terminal.

According to an example embodiment, an LED driver includes a driving current generator that generates a driving current controlling external LED devices, a driving current terminal receiving the driving current, a color temperature controller that generates a color temperature control signal corresponding to a target color temperature of a total light from the external LED devices, a switch circuit that selects one of a plurality of first division terminals or one of a plurality of second division terminals in response to the color temperature control signal and electrically connects the selected division terminal with the driving current terminal, a plurality of first resistance elements that is connected between the plurality of first division terminals and a first division current terminal, and a plurality of second resistance elements that is connected between the plurality of second division terminals and a second division current terminal, the first division current terminal and the second division current terminal being respectively connected with the external LED devices.

BRIEF DESCRIPTION OF THE DRAWINGS

Features will become apparent to those of skill in the art by describing in detail exemplary embodiments with reference to the attached drawings in which.

DETAILED DESCRIPTION

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Figure 1:
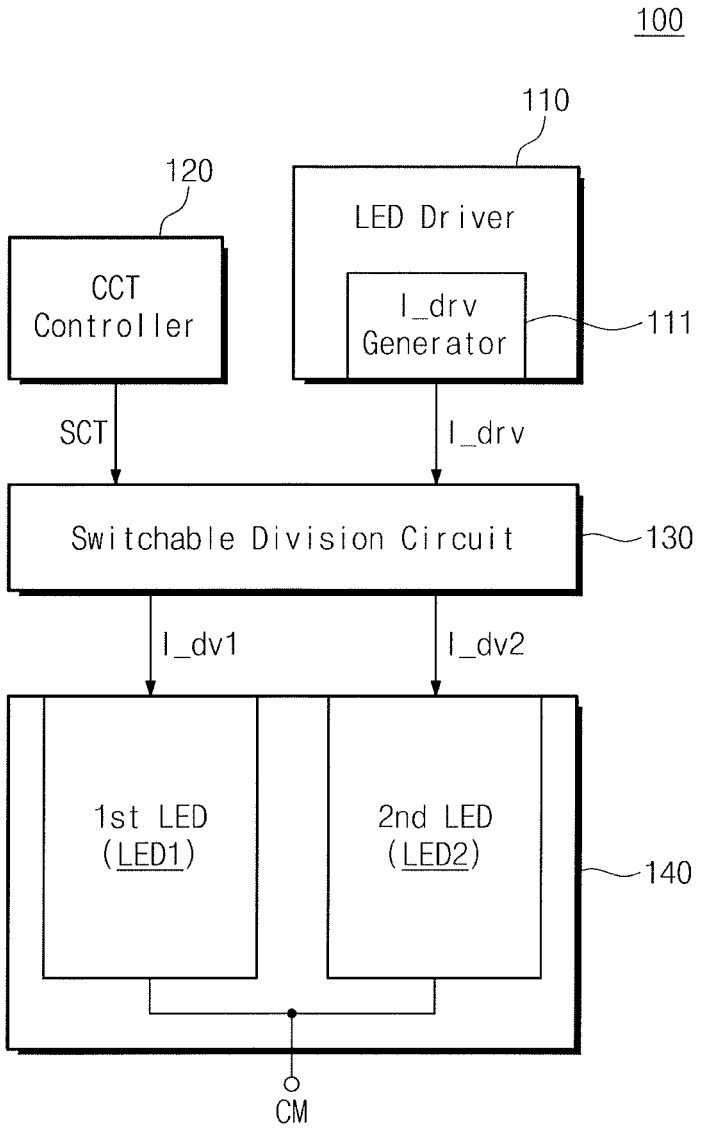
FIG. 1 illustrates a lighting apparatus according to an embodiment.

FIG. 1 illustrating a lighting apparatus according to an embodiment. Referring to FIG. 1, a lighting apparatus 100 may include an LED driver 110, a correlated color temperature (CCT) controller 120, a switchable division circuit 130, and an LED module 140. In an example embodiment, the lighting apparatus 100 may be an LED lighting apparatus which emits a light based on an LED element.

The LED driver 110 may output a driving current I_drv. For example, the LED driver 110 may include a driving current generator to generate the driving current I_drv. The driving current generator 111 may generate the driving current I_drv for adjusting the amount of a total light emitted from the lighting apparatus 100 under control of a user or a separate external device.

In an example embodiment, the amount of the total light emitted from the lighting apparatus 100 may increase as a magnitude of the driving current I_drv increases. That is, the LED driver 110 may adjust the amount (illuminance) of the total light emitted from the lighting apparatus 100 by adjusting the magnitude of the driving current I_drv. In an example embodiment, the driving current I_drv from the LED driver 110 may be output through one current channel or one driving channel.

The correlated color temperature controller 120 (hereinafter referred to as a "CCT controller") may control a correlated color temperature (CCT) control signal CTS (hereinafter referred to as a "color temperature control signal"). The color temperature control signal CTS may be a signal for adjusting a color temperature of the total light emitted from the lighting apparatus 100. That is, the color temperature control signal CTS may correspond to a target color temperature of the total light emitted from the lighting apparatus 100. The total light emitted from the lighting apparatus 100 may be light corresponding to a combination of first light emitted from a first LED light source LED1 and second light emitted from a second LED light source LED2. In an example embodiment, the color temperature control signal CTS may be a signal for controlling a switching circuit (to be described with reference to FIG. 3A) included in the switchable division circuit 130.

The switchable division circuit 130 (hereinafter referred to as a "division circuit") may divide the driving current I_drv from the LED driver 110 into the first and second division currents I_dv1 and I_dv2 in response to the color temperature control signal CTS. For example, the division circuit 130 may adjust magnitudes of the first division current I_dv1 and the second division current I_dv2 in response to the color temperature control signal CTS. In this case, the division circuit 130 may perform the above-described current dividing operation or the above-described current adjusting operation by using a switching circuit and a resistor circuit. A configuration and an operation of the division circuit 130 will be more fully described below.

The LED module 140 may include the first LED light source LED1 and the second LED light source LED2. The first and second LED light sources LED1 and LED2 may respectively receive the first and second division currents I_dv1 and I_dv2, and may be connected to a common terminal CM. In an example embodiment, the common terminal CM may be a ground terminal. The first LED light source LED1 may emit first light in response to the first division current I_dv1 from the division circuit 130. The second LED light source LED2 may emit second light in response to the second division current I_dv2 from the division circuit 130.

In an example embodiment, the first light and the second light may have different color temperatures, respectively. The first light may have a lowest color temperature in a variable color temperature range to be provided by the lighting apparatus 100, while the second light may have a highest color temperature in the variable color temperature range. For example, the first light may be "warm white" of approximately 2700K or lower, and the second light may be "cool white" of approximately 5700K or higher.

The amount of the first light emitted from the first LED light source LED1 may be determined according to the magnitude of the first division current I_dv1. The amount of the second light emitted from the second LED light source LED2 may be determined according to the magnitude of the second division current I_dv2. A color temperature of the total light emitted from the lighting apparatus 100 may be determined according to the amount of first light and the amount of second light. For example, when the amount of first light is greater than the amount of second light, the color temperature of the total light may be closer to the color temperature of first light than that of second light. Similarly, when the amount of first light is less than the amount of second light, the color temperature of the total light may be closer to the color temperature of second light than that of first light.

That is, the lighting apparatus 100 may change or adjust a target color temperature of the total light emitted from the lighting apparatus 100 by adjusting the magnitudes of the first and second division currents I_dv1 and I_dv2 respectively provided to the first and second LED light sources LED1 and LED2 having different color temperatures. In an example embodiment, a variable color temperature range associated with the total light may correspond to a range from a first color temperature of the first LED light source LED1 to a second color temperature of the second LED light source LED2.

As described above, the lighting apparatus 100 according to an embodiment may continuously change a color temperature within the variable color temperature range of the total light emitted by dividing the driving current I_drv provided through one current channel or one driving channel and adjusting the magnitudes of the first and second division currents I_dv1 and I_dv2. In this case, since a color temperature of the total light may be changed by using one LED driver 110, a simpler configuration and/or lower manufacturing may be realized compared with using a plurality of LED drivers. Also, since the first and second division currents I_dv1 and I_dv2 are generated by dividing the driving current I_drv, a number of LEDs may be reduced while the illuminance of the total light may be maintained at a given level or higher. Accordingly, a lighting apparatus according to embodiments may have improved performance and reduced costs.

Figure 2:
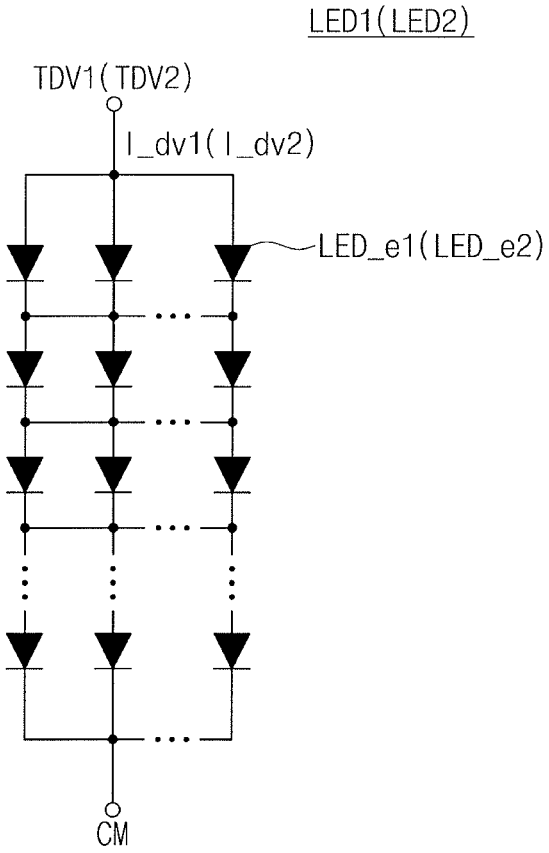
FIG. 2 illustrates a circuit diagram of a first LED light source of FIG. 1.

FIG. 2 is a circuit diagram illustrating a first LED light source of FIG. 1. Referring to FIG. 2, the first LED light source LED1 may include a plurality of LED elements LED_el. As illustrated in FIG. 2, the plurality of LED elements LED_el may be connected between a first division current terminal TDV1 and the common terminal CM in the serial-parallel structure. That is, each of the plurality of LED elements LED_el may emit a first light having a first color temperature in response to the first division current I_dv1.

In an example embodiment, the amount of a light emitted from each of the plurality of LED elements LED_el may vary with a magnitude of the first division current I_dv1. In an example embodiment, the amount of a light emitted from each of the plurality of LED elements LED_el may increase as a magnitude of the first division current I_dv1 increases.

As indicated in the parentheticals in FIG. 2, a configuration of the second LED light source LED2 may be similar to the configuration of the first LED light source LED1 illustrated in FIG. 2. For example, a plurality of LED elements included in the second LED light source LED2 may be connected between a second division current terminal TDV2 receiving the second division current I_dv2 and the common terminal CM in the serial-parallel structure, and each of the plurality of LED elements of the second LED light source LED2 may emit light of a second color temperature different from the first color temperature in response to the second division current I_dv2. The amount of light emitted from each of the plurality of LED elements of the second LED light source LED2 may increase as a magnitude of the second division current I_dv2 increases.

The first LED light source LED1 and the second LED light source LED2 are illustrated in FIG. 1 as a separate block. Alternatively, to make the total light corresponding to a combination of the first light and the second light natural, the LED elements of the first LED light source LED1 and the LED elements of the second LED light source LED2 may be arranged on the same substrate so as to have a particular pattern or to be intermixed with each other.

Figure 3A:
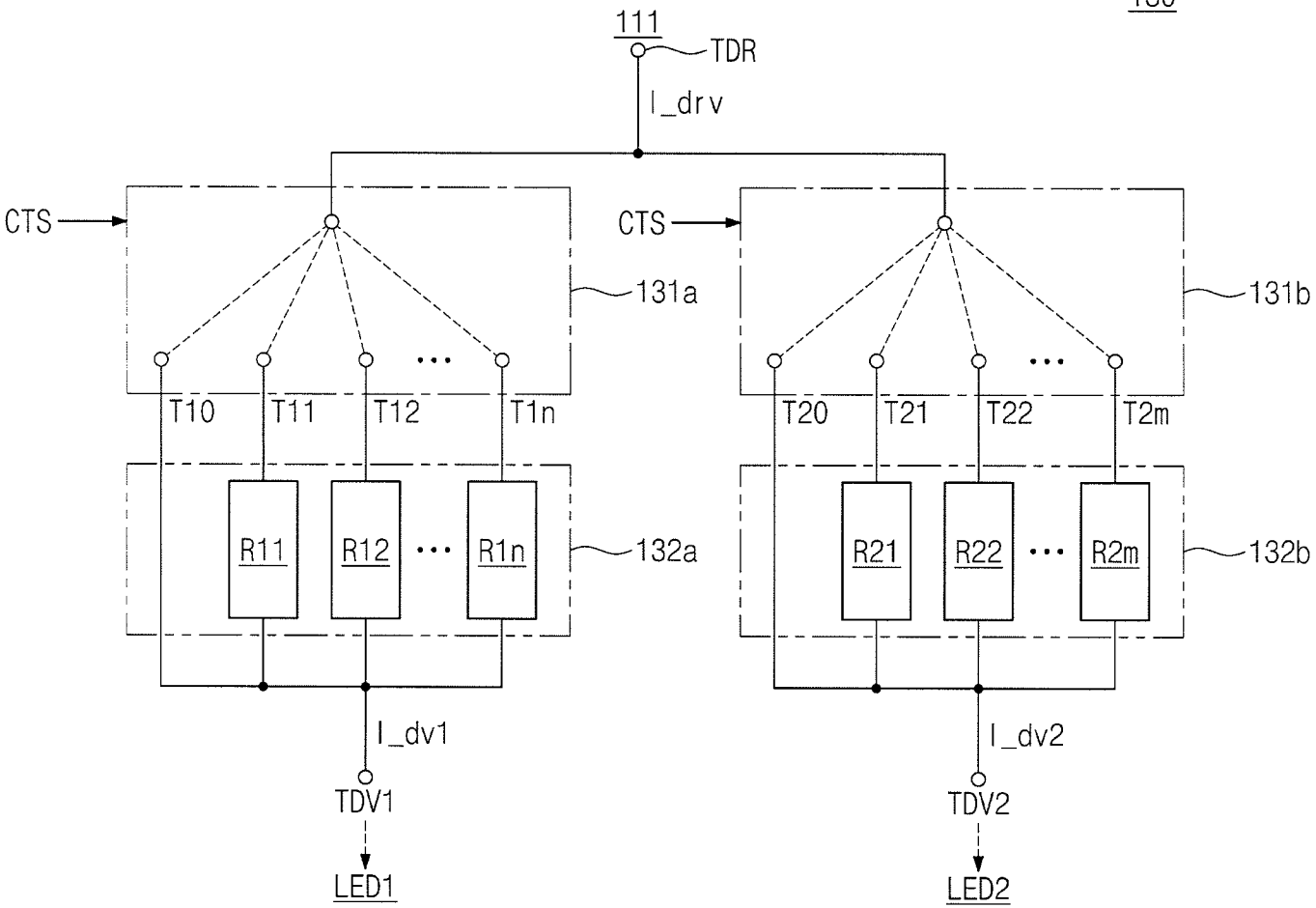
FIGS. 3A to 3C illustrate diagrams of a division circuit of FIG. 1.
Figure 3B:
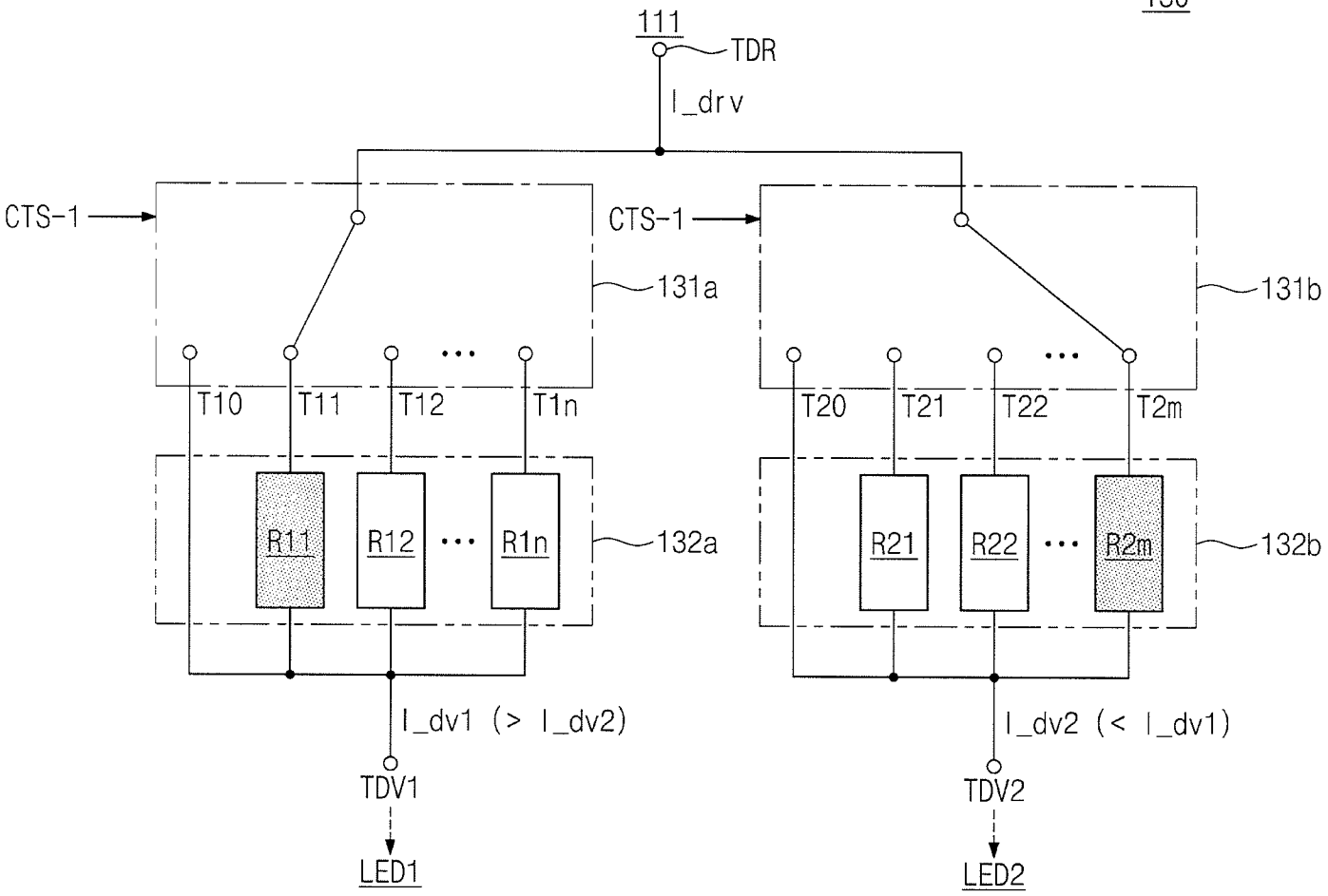
Figure 3C:
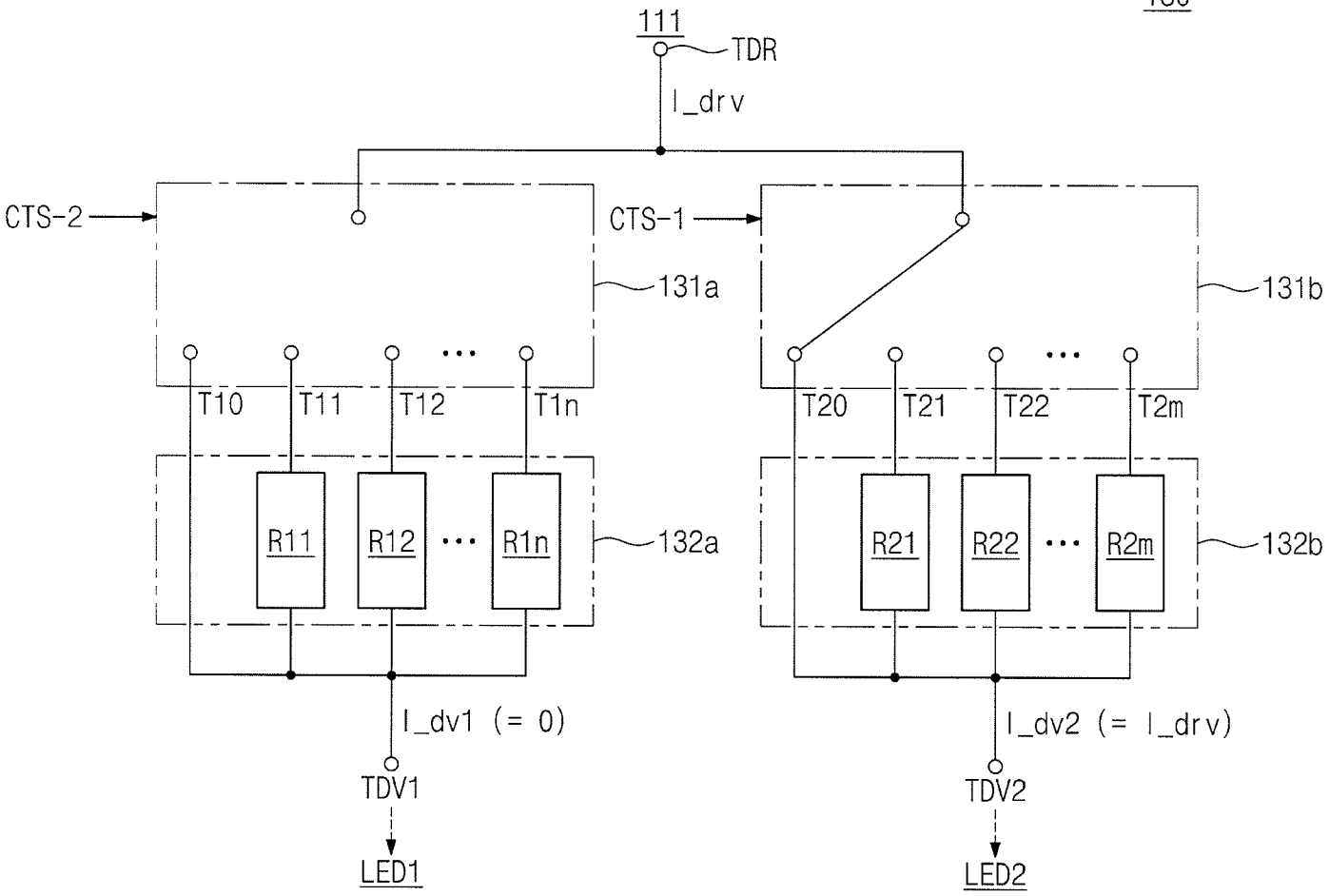

FIGS. 3A to 3C are diagrams illustrating a division circuit of FIG. 1. A configuration of the division circuit 130 will be described with reference to FIG. 3A, and a current dividing operation of the division circuit 130 will be described with reference to FIGS. 3B and 3C.

Referring to FIGS. 1 and 3A, the division circuit 130 is to output the first and second division currents I_dv1 and I_dv2 by dividing the driving current I_drv from the driving current generator 111 in response to the color temperature control signal CTS. For example, the division circuit 130 may include first and second switch circuits 131*a* and 131*b*, and first and second resistor circuits 132*a* and 132*b*.

The first switch circuit 131*a* is to selectively connect a driving current terminal TDR receiving the driving current I_drv to first division terminals T10 to T1*n* in response to the color temperature control signal CTS. For example, the first switch circuit 131*a* may electrically connect any one of the first division terminals T10 to T1*n* to the driving current terminal TDR receiving the driving current I_drv in response to the color temperature control signal CTS or may block the connection between the first division terminals T10 to T1*n* and the driving current terminal TDR.

The second switch circuit 131*b* selectively connects the driving current terminal TDR receiving the driving current I_drv to second division terminals T20 to T2*m* in response to the color temperature control signal CTS. For example, the second switch circuit 131*b* may electrically connect any one of the second division terminals T20 to T2*m* to the driving current terminal TDR receiving the driving current I_drv in response to the color temperature control signal CTS or may block the connection between the second division terminals T20 to T2*m* and the driving current terminal TDR.

In an example embodiment, the first and second switch circuits 131*a* and 131*b* may be implemented with switch elements, e.g., transistors, electric fuses, or the like, or a de-multiplexer to select the first and second division terminals T10 to T1*n* and T20 to T2*m* in response to the color temperature control signal CTS. In an example embodiment, the color temperature control signal CTS may be a signal for controlling the first and second switch circuits 131*a* and 131*b*. The color temperature control signal CTS may be provided in the form of a digital code for controlling the first and second switch circuits 131*a* and 131*b*.

The first resistor circuit 132*a* may include a plurality of first resistors R11 to R1*n* respectively connected between the first division terminals T11 to T1*n* and the first division current terminal TDV1. For example, the resistor R11 of the plurality of first resistors R11 to R1*n* may be connected between the division terminal T11 and the first division current terminal TDV1, the resistor R12 may be connected between the division terminal T12 and the first division current terminal TDV1, and the resistor R1*n* may be connected between the division terminal T1*n* and the first division current terminal TDV1. The division terminal T10 may be directly connected with the first division current terminal TDV1. In an embodiment, the plurality of first resistors R11 to R1*n* may have different resistance values.

The second resistor circuit 132*b* may include a plurality of second resistors R21 to R2*m* respectively connected between the second division terminals T21 to T2*m* and a second division current terminal TDV2. For example, the resistor R21 of the plurality of second resistors R21 to R2*m* may be connected between the division terminal 121 and the second division current terminal TDV2, the resistor R22 may be connected between the division terminal T22 and the second division current terminal TDV2, and the resistor R2*m* may be connected between the division terminal T2*m* and the second division current terminal TDV2. The division terminal T20 may be directly connected with the second division current terminal TDV2. In an embodiment, the plurality of second resistors R21 to R2*m* may have different resistance values.

In an example embodiment, the plurality of first resistors R11 to R1*n* and the plurality of second resistors R21 to R2*m* may respectively include single resistance elements having different resistance values, or each of the plurality of first resistors R11 to R1*n* and the plurality of second resistors R21 to R2*m* may include a plurality of resistance elements, the total resistance value of which is set to be different for each of the first and second resistors R11 to R1*n* and R21 to R2*m*. For example, the resistance values of the first resistors R11 to R1*n* may increase in a linear fashion and the resistance values of the second resistors R21 to R2*n* may increase in a linear fashion. When n and m are the same, respective resistance values may be equal, e.g., R11 equals R21, R12 equals R22, and so forth. At least one resistance value of the first resistors R11 to R1*n* may be equal to at least one resistance value of the second resistors R21 to R2*n* so that a middle color temperature of the variable color temperature range may be realized. There is no resistor provided for the first division terminal T10 or the second division terminal T20.

The first division current terminal TDV1 may be connected with the first LED light source LED1 and may provide the first division current I_dv1 to the first LED light source LED1. The second division current terminal TDV2 may be connected with the second LED light source LED2 and may provide the second division current I_dv2 to the second LED light source LED2.

According to an embodiment, as the first and second switch circuits 131*a* and 131*b* perform switching operations in response to the color temperature control signal CTS, the magnitudes of the first and second division currents I_dv1 and I_dv2 may change. For example, a first color temperature control signal CTS-1 may be a signal for adjusting a color temperature of the total light emitted from the lighting apparatus 100 to a first color temperature, and the first color temperature may be a color temperature included in a range from a color temperature of a first light of the first LED light source LED1 to a color temperature of a second light of the second LED light source LED2.

In this case, as illustrated in FIG. 3B, the first switch circuit 131*a* may electrically connect the driving current terminal TDR and the division terminal T11 in response to the first color temperature control signal CTS-1. The second switch circuit 131*b* may connect the driving current terminal TDR and the division terminal T2*m* in response to the first color temperature control signal CTS-1. In this case, the first resistor R11 of the first resistor circuit 132*a* and the second resistor R2*m* of the second resistor circuit 132*b* are connected in parallel between the first and second division current terminal TDV1 and TDV2 (or the first and second LED light sources LED1 and LED2) and the driving current terminal TDR.

In this case, the driving current I_drv may be divided into the first and second driving currents I_drv1 and I_dv2 depending on resistance values of the first and second resistors R11 and R2*m*. For example, as shown in FIG. 4B, when the resistance value of the first resistor R11 is smaller than the resistance value of the second resistor R2*m*, according to the voltage division law, the first driving current I_drv1 is greater than the second driving current I_drv2. Since the first driving current I_drv1 is greater than the second driving current I_drv2, the amount of first light emitted from the first LED light source LED1 may be greater than the amount of second light emitted from the second LED light source LED2.

In this case, a color temperature of the total light emitted from the lighting apparatus 100 may be closer to the color temperature of the first light. In detail, it is assumed that the first light emitted from the first LED light source LED1 is "warm white" (a CCT being approximately 2700K) and the second light emitted from the second LED light source LED2 is "cool white" (a CCT being approximately 5700K). When the first and second switch circuits 131*a* and 131*b* are connected as illustrated in FIG. 3B, since the first division current I_dv1 is greater than the second division current I_dv2, the amount of warm white light is greater than the amount of cool white light. In this case, the total light emitted from the lighting apparatus 100 may have a color temperature (e.g., approximately 3000K) which is closer to the warm white than to the cool white light.

As described above, a color temperature of the total light emitted from the lighting apparatus 100 may be adjusted by adjusting the magnitudes of the first and second division currents I_dv1 and I_dv2 by using the first and second switch circuits 131*a* and 131*b* and the first and second resistor circuits 132*a* and 132*b*.

In an example embodiment, the total light emitted from the lighting apparatus 100 may have a color temperature corresponding to any one of the first and second LED light sources LED1 and LED2. For example, as shown in FIG. 3C, a second color temperature control signal CTS-2 may be a signal for adjusting a color temperature of the total light emitted from the lighting apparatus 100 to a second color temperature. The second color temperature may be substantially identical to the color temperature of the second light of the second LED light source LED2.

In this case, as illustrated in FIG. 3C, the first switch circuit 131*a* may block the connection between the driving current terminal TDR and the first division terminals T10 to T1*n*, e.g., be disconnected there from, in response to the second color temperature control signal CTS-2. The second switch circuit 131*b* may electrically connect the driving current terminal TDR and the second division terminal T20 having no resistor connected thereto in response to the second color temperature control signal CTS-2.

The driving current I_drv may be directly provided to the second LED light source LED2 by the second switch circuit 131*b*. That is, the magnitude of the second division current I_dv2 may be substantially identical to the magnitude of the driving current I_drv. In contrast, by the first switch circuit 131*a*, the first division current I_dv1 which is provided to the first LED light source LED1 may be blocked. That is, the first division current I_dv1 may be substantially "0".

In this case, the first LED light source LED1 may not emit light and only the second LED light source LED2 may emit light. That is, the total light emitted from the lighting apparatus 100 may be identical to the second light, i.e., cool white light.

In a conventional color temperature-variable lighting apparatus, a color temperature of the total light is adjusted by individually controlling currents to be provided to LED light sources having different color temperatures. Since this requires a separate driver or a separate current channel for each of the LED light sources, implementation of conventional color temperature-variable lighting apparatus is complex and costly.

However, as described above, the lighting apparatus 100 may divide and output the driving current I_drv provided through one current channel or one driving channel into the first and second division currents I_dv1 and I_dv2 by using the division circuit 130. In this case, magnitudes of the first and second division currents I_dv1 and I_dv2 may be adjusted by using the first and second switch circuits 131*a* and 131*b* and the first and second resistor circuits 132*a* and 132*b* included in the division circuit 130, and a color temperature of the total light emitted from the lighting apparatus 100 may be adjusted according to the magnitudes of the first and second division currents I_dv1 and I_dv2.

In addition, the lighting apparatus 100 may output the total light having an intensity that is equal to that of the conventional color temperature-variable lighting apparatus using fewer LED elements. Accordingly, a color temperature-variable lighting apparatus having reduced costs and complexity is provided.

Figure 4:
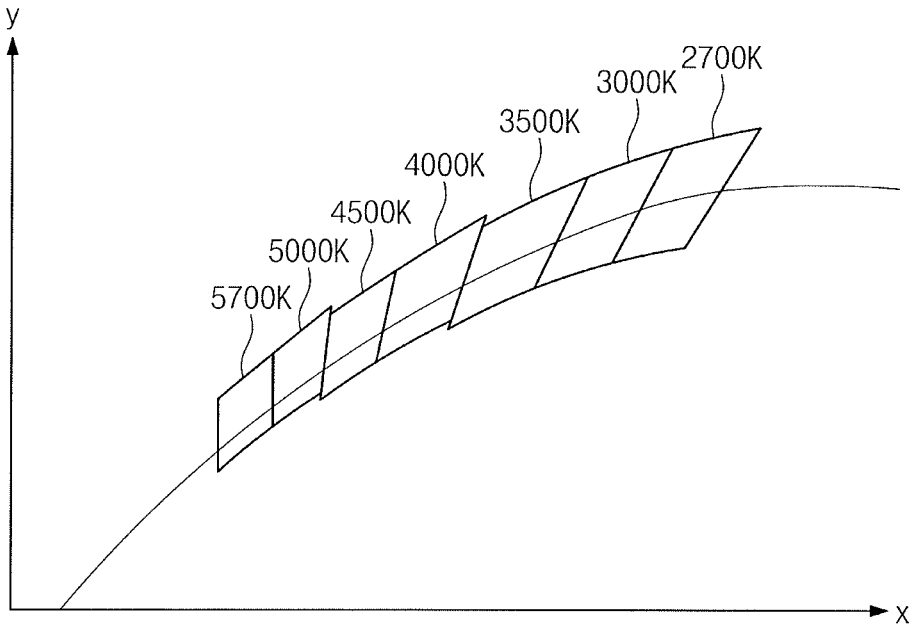
FIG. 4 illustrates a xy chromaticity coordinate diagram for describing a range where a color temperature of a lighting apparatus of FIG. 1 is adjusted.

FIG. 4 illustrates a xy chromaticity diagram for describing a variable color temperature range over which a color temperature of a lighting apparatus of FIG. 1 is adjusted. In a graph of FIG. 4, an x-axis represents an index of an x-chromaticity coordinate, and a y-axis represents an index of a y-chromaticity coordinate. Referring to FIGS. 1 and 4, the first LED light source LED1 may emit first light having a color temperature of approximately 2700K, and the second LED light source LED2 may emit second light having a color temperature of approximately 5700K. In this case, a color temperature of the total light output from the lighting apparatus 100 may be variously adjusted by a current dividing operation of the division circuit 130. Table 1 shows terminals selected by switch circuits based on a target color temperature, magnitudes of connected resistors, and magnitudes of division currents.

TABLE 1

| Target Color Temperature | First Division Terminal | Second Division Terminal | Resistance Magnitude | Division Current Magnitude |
|---|---|---|---|---|
| 2700K | T10 | — | — | I_dv1 = I_drv, I_dv2 = 0 |
| 3000K | T11 | T2m | R11 < R2m | I_dv1 > I_dv2 |

TABLE 1-continued

| Target Color Temperature | First Division Terminal | Second Division Terminal | Resistance Magnitude | Division Current Magnitude |
|---|---|---|---|---|
| 4000K | T12 | T22 | R12 = R22 | I_dv1 = I_dv2 |
| 5000K | T1n | T21 | R1n > R21 | I_dv1 < I_dv2 |
| 5700K | — | T20 | — | I_dv1 = 0, I_dv2 = I_drv |

As may be seen in FIG. 4 and Table 1, the division circuit 130 may divide the driving current I_drv in response to the color temperature control signal CTS such that the total light has a target color temperature over the variable color temperature range.

Figure 5:
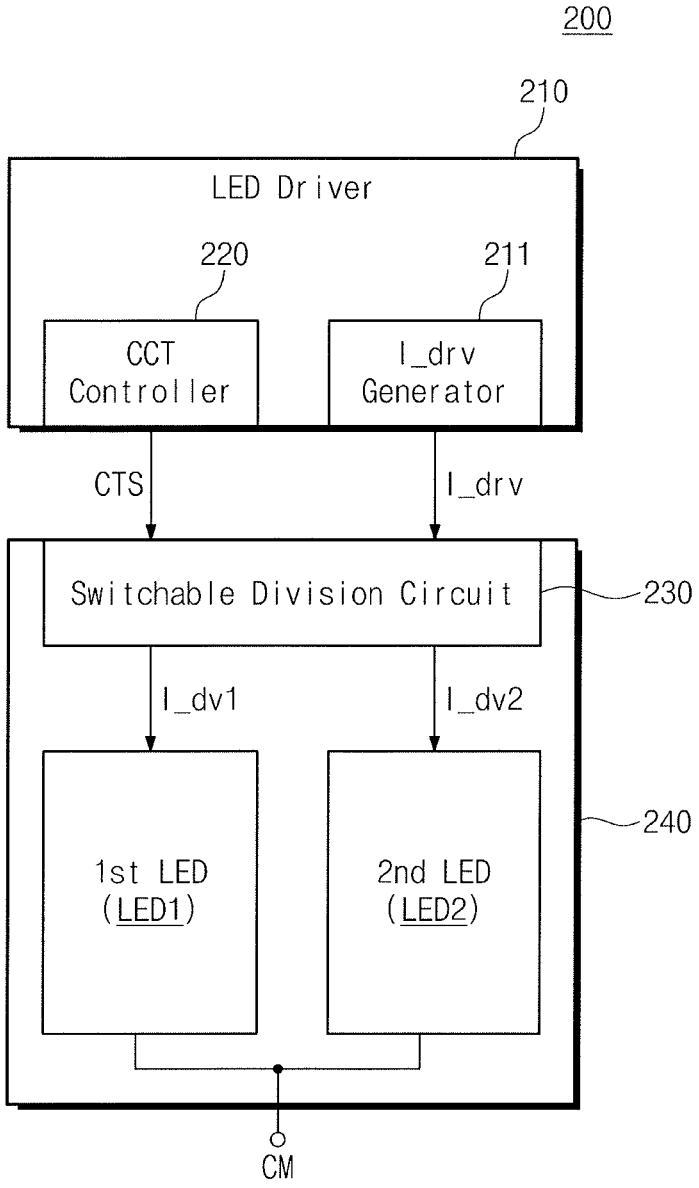
FIG. 5 illustrates a lighting apparatus according to an embodiment.

FIG. 5 illustrates a lighting apparatus according to an embodiment. For convenience of description, additional description associated with the above-described components will be omitted to avoid redundancy.

Referring to FIG. 5, a lighting apparatus 200 may include an LED driver 210 and an LED module 240. The LED driver 210 may include a driving current generator 211 and a CCT controller 220. The LED module 240 may include a switchable division circuit 230, the first LED light source LED1, and the second LED light source LED2. Functions or operations of components illustrated in FIG. 5 are similar to the functions or operations of the components described with reference to FIGS. 1 to 4, and thus, additional description will be omitted to avoid redundancy.

The LED driver 110, the CCT controller 120, the division circuit 130, and the LED module 140 of the lighting apparatus 100 of FIG. 1 may be implemented to be independent of each other. For example, the LED driver 110, the CCT controller 120, the division circuit 130, and the LED module 140 of the lighting apparatus 100 of FIG. 1 may be implemented with different semiconductor chips, different semiconductor modules, or different semiconductor packages.

In contrast, the CCT controller 220 of the lighting apparatus 200 of FIG. 5 may be included in the LED driver 210. That is, the LED driver 210 may provide the color temperature control signal CTS and the driving current I_drv to the LED module 240 for the purpose of adjusting a color temperature of the total light of the lighting apparatus 200. In other words, the driving current generator 211 and the CCT controller 220 may be implemented with one semiconductor chip, one semiconductor package, or one semiconductor module so as to be included in the LED driver 210.

Unlike the lighting apparatus 100 of FIG. 1, the switchable division circuit 230 (i.e., a division circuit 230) of FIG. 5 may be included in the LED module 240. For example, the division circuit 230, the first LED light source LED1, and the second LED light source LED2 included in the LED module 240 may be formed on the same semiconductor substrate. Alternatively, the division circuit 230, the first LED light source LED1, and the second LED light source LED2 included in the LED module 240 may be implemented with one semiconductor chip, one semiconductor package, or one semiconductor module.

Figure 6:
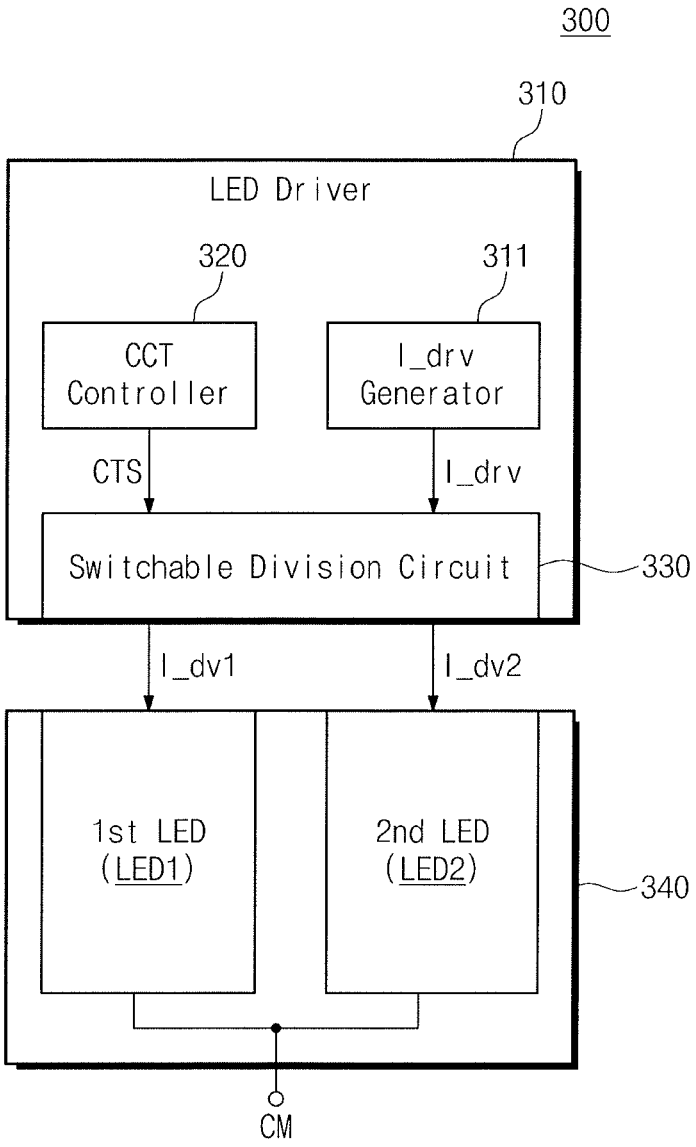
FIG. 6 illustrates a lighting apparatus according to an embodiment.

FIG. 6 illustrates a lighting apparatus according to an embodiment. For convenience of description, additional description associated with the above-described components will be omitted to avoid redundancy.

Referring to FIG. 6, a lighting apparatus 300 may include an LED driver 310 and an LED module 340. Unlike the LED driver 110 of FIG. 1 or the LED driver 210 of FIG. 5, the LED driver 310 of FIG. 6 may include a driving current generator 311, a CCT controller 320, and a switchable division circuit 330. That is, the LED driver 310 may divide the driving current I_drv into the first and second division currents I_dv1 and I_dv2 depending on the color temperature control signal CTS of the CCT controller 320, and to provide the first and second division currents I_dv1 and I_dv2 to the LED module 340. As in the above description, the driving current generator 311, the CCT controller 320, and the division circuit 330 of the LED driver 310 may be implemented in one semiconductor chip, one semiconductor module, or one semiconductor package.

The LED module 340 may include the first LED light source LED1 and the second LED light source LED2. The LED module 340 is identical to the LED module 140 of FIG. 1, and thus, additional description will be omitted to avoid redundancy.

Figure 7:
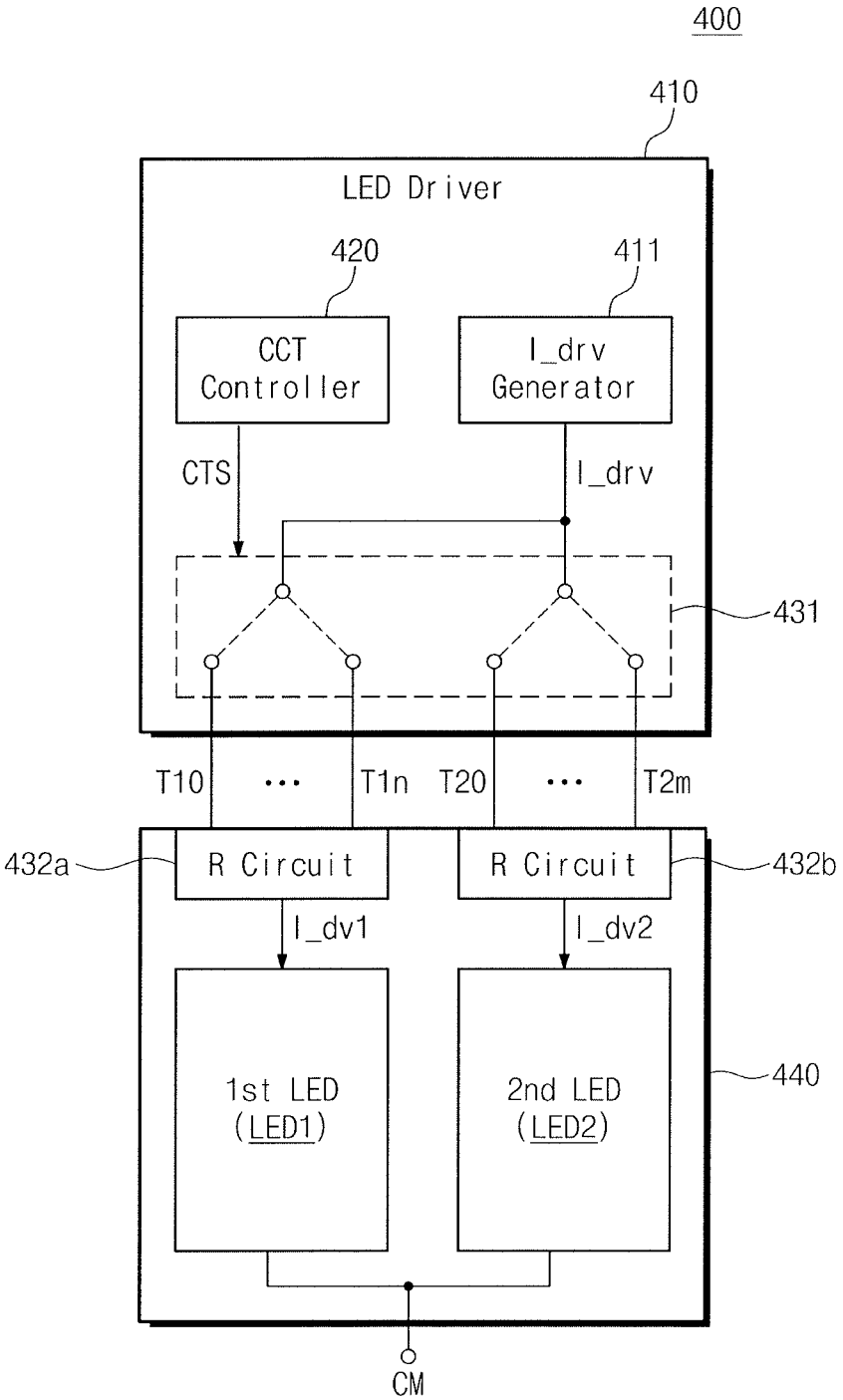
FIG. 7 illustrates a lighting apparatus according to an embodiment.

FIG. 7 illustrates a lighting apparatus according to an embodiment. For convenience of description, additional description associated with the above-described components will be omitted to avoid redundancy.

Referring to FIG. 7, a lighting apparatus 400 may include an LED driver 410 and an LED module 440. Unlike the LED drivers 110, 210, and 310 of FIGS. 1, 5, and 6, the LED driver 410 of FIG. 7 may include a driving current generator 411, a CCT controller 420, and a switch circuit 431. The switch circuit 431 may be connected with the LED module 440 through the plurality of first terminals T10 to T1*n* and the plurality of second terminals T20 to T2*m*. In an example embodiment, the driving current generator 411, the CCT controller 420, and the switch circuit 431 of the LED driver 410 may be implemented with one semiconductor chip, one semiconductor module, or one semiconductor package.

Unlike the LED modules 140, 240, and 340 of FIGS. 1, 5, and 6, the LED module 440 of FIG. 7 may include a first resistor circuit 432*a*, a second resistor circuit 432*b*, the first LED light source LED1, and the second LED light source LED2. As described with reference to FIG. 3A, the first resistor circuit 432*a* may include a plurality of first resistors respectively connected with the plurality of first terminals T10 to T1*n*, and the second resistor circuit 432*b* may include a plurality of second resistors respectively connected with the plurality of second terminals T20 to T2*m*. In an example embodiment, the first resistor circuit 432*a*, the second resistor circuit 432*b*, the first LED light source LED1, and the second LED light source LED2 included in the LED module 440 may be implemented with one semiconductor chip, one semiconductor package, or one semiconductor module. Alternatively, the first resistor circuit 432*a* and the first LED light source LED1 may be implemented with one semiconductor chip, one semiconductor package, or one semiconductor module, and the second resistor circuit 432*b* and the second LED light source LED2 may be implemented with another semiconductor chip, another semiconductor package, or another semiconductor module.

As illustrated in FIG. 7, the switch circuit 431 included in the LED driver 410 may be configured to electrically connect a driving current terminal configured to receive the driving current I_drv with any one of the plurality of first terminals T10 to T1*n* or any one of the plurality of second terminals T20 to T2*m* in response to the color temperature control signal CTS of the CCT controller 420.

By a switching operation of the switch circuit 431 included in the LED driver 410, the driving current terminal may be electrically connected with any one of the plurality of first resistors of the first resistor circuit 432*a* in the LED module 440 or any one of the plurality of second resistors of the second resistor circuit 432*b* in the LED module 440. As such, the magnitudes of the first and second division currents I_dv1 and I_dv2 may be adjusted.

Figure 8:
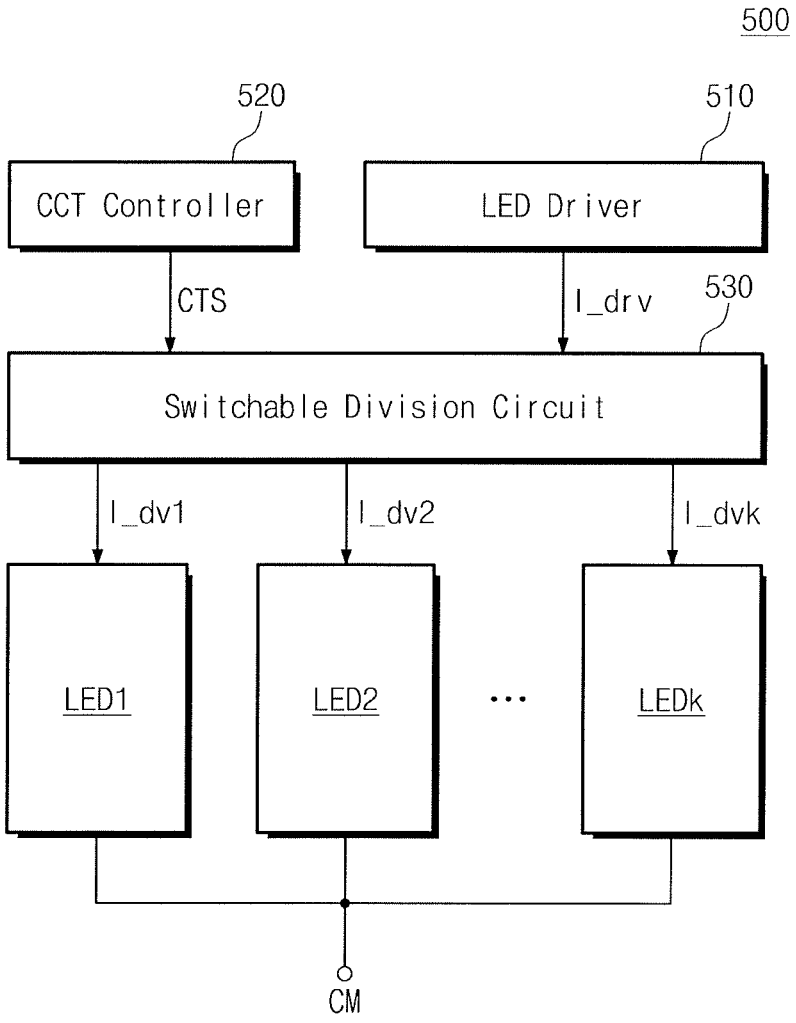
FIG. 8 illustrates a lighting apparatus according to an embodiment.

FIG. 8 illustrates a lighting apparatus according to an embodiment. For convenience of description, additional description associated with the above-described components will be omitted to avoid redundancy. Referring to FIG. 8, a lighting apparatus 500 may include an LED driver 510, a CCT controller 520, a division circuit 530, and a plurality of LED light sources LED1 to LEDk.

The division circuit 530 may divide the driving current I_drv in response to the color temperature control signal CTS from the CCT controller 520 and may output a plurality of division currents I_dv1 to I_dvk. For example, as in the above description, the division circuit 530 may include pairs of switch and resistor circuits (not illustrated) respectively corresponding to the plurality of LED light sources LED1 to LEDk, and may adjust magnitudes of the plurality of division currents I_dv1 to I_dvk to be provided respectively to the plurality of LED light sources LED1 to LEDk by using the pairs of switch and resistor circuits.

The plurality of LED light sources LED1 to LEDk may respectively receive the plurality of division currents I_dv1 to I_dvk from the division circuit 530 and may emit lights having different color temperatures based on the received division currents I_dv1 to I_dvk. For example, the first LED light source LED1 may receive the first division current I_dv1 from the division circuit 530 and may emit a first light of a first color temperature based on the first division current I_dv1. The second LED light source LED2 may receive the second division current I_dv2 from the division circuit 530 and may emit a second light of a second color temperature higher than the first color temperature based on the second division current I_dv2. The k-th LED light source LEDk may receive the k-th division current I_dvk from the division circuit 530 and may emit a light of a k-th color temperature higher than the second color temperature based on the k-th division current I_dvk.

As described above, a target color temperature of the total light emitted from the lighting apparatus 500 may be adjusted by adjusting the magnitudes of the plurality of division currents I_dv1 to I_dvk.

The lighting apparatuses 100, 200, 300, 400, and 500 described with reference to FIGS. 1 and 5 to 8 are example embodiments for implementing the scope and spirit of embodiments.

Figure 9:
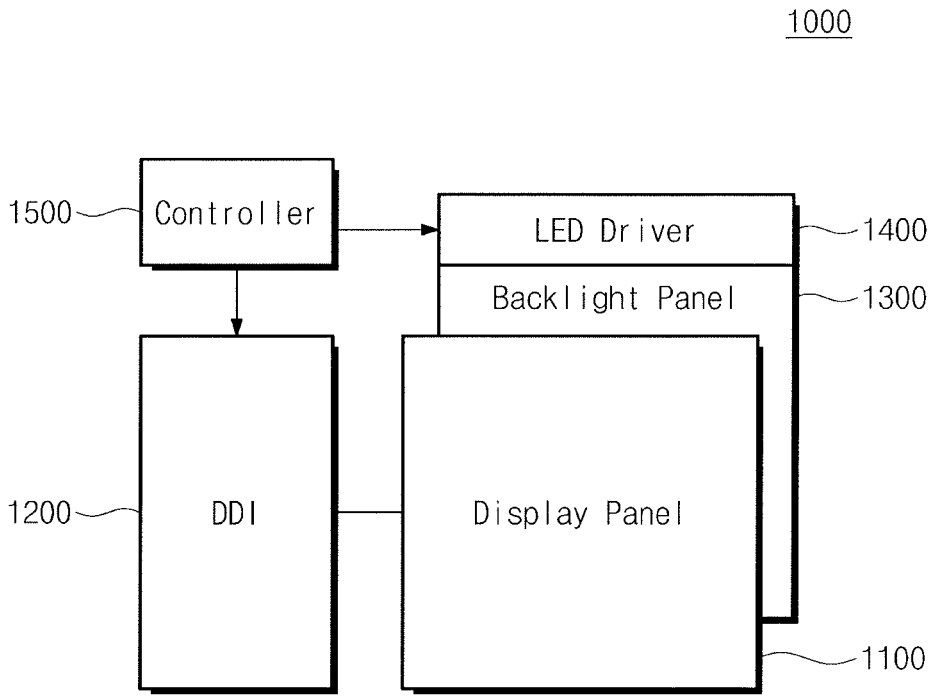
FIG. 9 illustrates a display device incorporating a lighting apparatus according to the embodiments.

FIG. 9 illustrates a display device including a lighting apparatus according to the embodiments. Referring to FIG. 9, a display device 1000 may include a display panel 1100, a display driving integrated circuit (DDI) 1200, a backlight panel 1300, an LED driver 1400, and a controller 1500.

The display panel 1100 may include a plurality of display pixels. The plurality of display pixels may be connected with a plurality of gate lines and a plurality of data lines and may be configured to display image information in response to signals of connected lines. In an example embodiment, the plurality of display pixels may be classified into a plurality of groups based on colors to be displayed. The plurality of display pixels may display one of primary colors. The primary colors may include, but not limited to, red, green, blue, and white. For example, the primary colors may further include various colors such as yellow, cyan, and magenta. In an example embodiment, the display panel 1100 may be a liquid crystal display panel.

The DDI 1200 may control various signal lines (e.g., a plurality of data lines or a plurality of gate lines) connected with the display panel 1100 under control of the controller 1500.

The backlight panel 1300 may output a light such that image information may be output through the display panel 1100. In an example embodiment, the backlight panel 1300 may include the LED module or the LED light sources described with reference to FIGS. 1 to 8.

The LED driver 1400 may control the backlight panel 1300. The LED driver 1400 may provide a driving current or a division current to an LED module under control of the controller 1500 such that the backlight panel 1300 emits a light of a target color temperature. The controller 1500 may control the DDI 1200 or the LED driver 1400 such that image information may be displayed through a plurality of pixels included in the display panel 1100.

In an example embodiment, a lighting apparatus according to the embodiments may used in various fields (e.g., an image sensor, a display device, a lighting apparatus, a headlight, etc.) to which LED lighting is applied.

As described above, according to embodiments, a lighting apparatus may control a color temperature over a wide range by adjusting magnitudes of a plurality of division currents obtained by dividing a driving current provided through one current channel. Also, even though fewer LED elements are used, the total light having the same intensity as the related art may be provided. Accordingly, a color temperature-variable lighting apparatus having reduced manufacturing costs and improved performance is provided.

According to embodiments, division currents may be generated by dividing a driving current provided through one current channel, and LED light sources may emit lights having different color temperatures based on the division currents thus generated. As such, a color temperature of the total light emitted from a lighting apparatus may be variously changed. Accordingly, an LED module, an LED driver, and an LED lighting apparatus having reduced cost and improved performance are provided.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A light emitting diode (LED) lighting apparatus, comprising:

an LED driver to output a driving current;

a switch circuit to select one of first division and second division terminals or one of third and fourth division terminals in response to a color temperature control signal corresponding to a target color temperature and to electrically connect the selected division terminal with a driving current terminal receiving the driving current;

a first resistor circuit connected to the first and second division terminals;

a second resistor circuit connected to the third and fourth division terminals;

a first LED light source electrically connected with the first resistor circuit, the first LED light source to emit first light having a first color temperature; and a second LED light source electrically connected with the second resistor circuit, the second LED light source to emit second light having a second color temperature higher than the first color temperature.

2. The LED lighting apparatus as claimed in claim 1, wherein:

the first resistor circuit includes:

a first resistance element connected with the first division terminal; and a second resistance element connected with the second division terminal, and wherein the second resistor circuit includes:

a third resistance element connected with the third division terminal and having a resistance value greater than the first resistance element; and a fourth resistance element connected with the fourth division terminal and having a resistance value smaller than the second resistance element.

3. The LED lighting apparatus as claimed in claim 2, further comprising:

a correlated color temperature (CCT) controller to generate the color temperature control signal wherein the target color temperature correspond to a color temperature of a total light corresponding to a combination of the first light and the second light.

4. The LED lighting apparatus as claimed in claim 3, wherein the target color temperature is in a range from the first color temperature to the second color temperature.

5. The LED lighting apparatus as claimed in claim 3, wherein, when the target color temperature is a first value, in response to the color temperature control signal, the switch circuit selects the first division terminal and the third division terminal so as to be connected with the driving current terminal, and when the target color temperature is a second value greater than the first value, in response to the color temperature control signal, the switch circuit selects the second division terminal and the fourth division terminal so as to be connected with the driving current terminal.

6. The LED lighting apparatus as claimed in claim 3, wherein:

when the target color temperature is the first color temperature, in response to the color temperature control signal, the switch circuit connects the driving current terminal directly with the first LED light source and blocks a connection between the driving current terminal and the third and fourth division terminals, and when the target color temperature is the second color temperature, in response to the color temperature control signal, the switch circuit connects the driving current terminal directly with the second LED light source and blocks a connection between the driving current terminal and the first and second division terminals.

7. The LED lighting apparatus as claimed in claim 1, wherein the amount of a total light corresponding to a combination of the first light and the second light corresponds to a magnitude of the driving current.

8. The LED lighting apparatus as claimed in claim 1, wherein:

the LED driver is implemented with a first semiconductor chip, the switch circuit, the first resistor circuit, and the second resistor circuit are implemented with a second semiconductor chip, and the first LED light source and the second LED light source are implemented with a third semiconductor chip.

9. The LED lighting apparatus as claimed in claim 1, wherein:

the LED driver is implemented with a first semiconductor chip, and the switch circuit, the first resistor circuit, the second resistor circuit, the first LED light source, and the second LED light source are implemented with a second semiconductor chip.

10. An LED module, comprising:

a first LED light source to receive a first division current through a first division current terminal and to emit first light having a first color temperature based on the first division current;

a second LED light source to receive a second division current through a second division current terminal and to emit second light having a second color temperature based on the second division current; and a division circuit connected with a driving current terminal receiving a driving current from an external device, the first division current terminal, and the second division current terminal, the division circuit to divide the driving current into a first division current and a second division current in response to a color temperature control signal from the external device, wherein the division circuit outputs the first division current to the first division current terminal and the second division current to the second division current terminal, wherein the division circuit includes:

a first switch circuit to select one of a plurality of first division terminals in response to the color temperature control signal and to connect the selected first division terminal with the driving current terminal;

a second switch circuit to select one of a plurality of second division terminals in response to the color temperature control signal and to connect the selected second division terminal with the driving current terminal;

a plurality of first resistance elements connected between the plurality of first division terminals and the first division current terminal, respectively; and a plurality of second resistance elements connected between the plurality of second division terminals and the second division current terminal, respectively.

11. The LED module as claimed in claim 10, wherein the color temperature control signal corresponds to a target color temperature of a total light corresponding to a combination of the first light and the second light.

12. The LED module as claimed in claim 11, wherein:

when the target color temperature is a first value, the first division current is greater than the second division current, and when the target color temperature is a second value greater than the first value, the first division current is smaller than the second division current.

13. The LED module as claimed in claim 11, wherein:

the target color temperature is in a range from the first color temperature to the second color temperature;

when the target color temperature is the first color temperature, the division circuit outputs the driving current as the first division current; and when the target color temperature is the second color temperature, the division circuit outputs the driving current as the second division current.

14. An LED driver, comprising:

a driving current generator to generate a driving current to control external LED devices;

a driving current terminal receiving the driving current;

a color temperature controller to generate a color temperature control signal corresponding to a target color temperature of a total light from the external LED devices;

a switch circuit to select one of a plurality of first division terminals or one of a plurality of second division terminals in response to the color temperature control signal and to electrically connect the selected division terminal with the driving current terminal;

a plurality of first resistance elements respectively connected between the plurality of first division terminals and a first division current terminal; and a plurality of second resistance elements connected respectively between the plurality of second division terminals and a second division current terminal, wherein the first division current terminal and the second division current terminal are respectively connected with the external LED devices.

15. The LED driver as claimed in claim 14, wherein a first division current and a second division current generated by dividing the driving current are respectively provided to the external LED devices through the first division current terminal and the second division current terminal.

16. The LED driver as claimed in claim 14, wherein:

when the target color temperature is a first value, in response to the color temperature control signal, the switch circuit selects one of the plurality of first division terminals such that a resistance element, which has a first resistance value, from among the plurality of first resistance elements is connected with the driving current terminal and selects one of the plurality of second division terminals such that a resistance element, which has a second resistance value greater than the first resistance value, from among the plurality of second resistance elements is connected with the driving current terminal, and when the target color temperature is a second value greater than the first value, in response to the color temperature control signal, the switch circuit selects one of the plurality of first division terminals such that a resistance element, which has a third resistance value, from among the plurality of first resistance elements is connected with the driving current terminal and selects one of the plurality of second division terminals such that a resistance element, which has a fourth resistance value smaller than the third resistance value, from among the plurality of second resistance elements is connected with the driving current terminal.

17. The LED driver as claimed in claim 14, wherein:

the target color temperature of the total light is in a range from a first color temperature of a light, which has a lowest color temperature, from among light respectively emitted from the external LED devices to a second color temperature of a light, which has a highest color temperature, from among the lights respectively emitted from the external LED devices;

when the target color temperature is the first color temperature, in response to the color temperature control signal, the switch circuit outputs the driving current directly to the first division current terminal and blocks current from the second division current terminal, and when the target color temperature is the second color temperature, in response to the color temperature control signal, the switch circuit connects the driving current terminal directly with the second division current terminal and blocks current from the first division current terminal.

18. The LED driver as claimed in claim 14, wherein the amount of the total light is determined according to a magnitude of the driving current.

* * * * *